US006354468B1

(12) United States Patent
Riek

(10) Patent No.: US 6,354,468 B1
(45) Date of Patent: Mar. 12, 2002

(54) BEVERAGE DISPENSER TRANSPONDER IDENTIFICATION SYSTEM

(75) Inventor: Jan C. Riek, Madison, WI (US)

(73) Assignee: DEC International, Inc., Madison, WI (US)

( * ) Notice: Subject to any disclaimer, the term of this patent is extended or adjusted under 35 U.S.C. 154(b) by 0 days.

(21) Appl. No.: 09/691,719

(22) Filed: Oct. 18, 2000

(51) Int. Cl.[7] ..... B67D 5/00
(52) U.S. Cl. ..... 222/129.3; 222/30; 222/37
(58) Field of Search ..... 222/129.1, 129.2, 222/129.3, 129.4, 144.5, 30, 36–38

(56) References Cited

U.S. PATENT DOCUMENTS

| | | | | | |
|---|---|---|---|---|---|
| 3,656,145 | A | * | 4/1972 | Proope | 222/30 |
| 3,920,149 | A | | 11/1975 | Fortino et al. | 222/1 |
| 4,196,481 | A | | 4/1980 | Kip et al. | 340/152 |
| 4,278,186 | A | | 7/1981 | Williamson | 222/36 |
| 4,580,041 | A | | 4/1986 | Walton | 235/380 |
| 4,654,658 | A | | 3/1987 | Walton | 340/825.54 |
| 4,656,472 | A | | 4/1987 | Walton | 340/825.34 |
| 4,730,188 | A | | 3/1988 | Milheiser | 340/825 |
| 5,255,819 | A | | 10/1993 | Peckels | 222/1 |
| 5,295,611 | A | | 3/1994 | Simard | 222/129.3 |
| 5,379,916 | A | * | 1/1995 | Martindale et al. | 222/30 |
| 5,505,349 | A | * | 4/1996 | Peckels | 222/36 |
| 5,603,430 | A | | 2/1997 | Loehrker et al. | 222/1 |
| 5,731,981 | A | | 3/1998 | Simard | |
| 5,854,793 | A | * | 12/1998 | Dinkins | 370/503 |
| 5,923,572 | A | * | 7/1999 | Pollock | 364/528.17 |
| 6,070,156 | A | * | 5/2000 | Hartsell, Jr. | 705/413 |
| 6,206,340 | B1 | * | 3/2001 | Paese et al. | 251/129.04 |

* cited by examiner

*Primary Examiner*—J. Casimer Jacyna
(74) *Attorney, Agent, or Firm*—Andrus, Sceales, Starke & Sawall, LLP

(57) ABSTRACT

A beverage dispenser transponder identification system includes a pourer spout for insertion into a bottle containing a beverage, the pourer spout having an electromagnetically actuated stopper valve for dispensing the beverage, the pourer spout having an rf receive/transmit antenna connected to an identification transponder circuit. An actuator is provided by an activator ring for insertion around the pourer spout and has a driver coil for actuating the stopper valve, an rf transmit antenna connected to an oscillator, and an rf receive antenna connected to a decoder. The rf transmit antenna broadcasts an rf signal to the rf receive/transmit antenna which is conducted to the identification transponder circuit which sends an identification signal to the rf receive/transmit antenna which is broadcast to the rf receive antenna and received by the decoder to identify the pourer spout.

13 Claims, 2 Drawing Sheets

BEVERAGE DISPENSER TRANSPONDER IDENTIFICATION SYSTEM

FIELD OF THE INVENTION

The invention relates to systems for dispensing beverages from bottles, and more particularly to a transponder identification system including for dispensing measured amounts of liquid from an identified bottle for accounting quantity and cost.

BACKGROUND OF THE INVENTION

A bartender commonly pours liquor from a bottle into a glass in which a drink is being mixed. A pourer spout is often attached to the mouth of the bottle to dispense the liquor at a relatively constant flow rate so that the bartender can "free pour" the liquor without the need for a measuring device, such as a jigger. Even at a constant flow rate, the exact amount of liquor poured into each drink varies depending upon the bartender, and varies from drink to drink poured by the same bartender. Such variation affects the profits derived from a given bottle of liquor. In addition, simple bottle spouts do not provide any mechanism to ensure that each drink dispensed from a bottle was rung up on the cash register. Thus, a bartender has been able to serve free or generous drinks to friends and preferred customers without accounting to the tavern management.

In response to these problems, more sophisticated liquor dispensing equipment has been devised. One such system is described in U.S. Pat. No. 3,920,149 and provides each bottle with a pourer spout that has a magnetically operated valve. When liquor was to be poured from a given bottle, its spout was placed inside an actuator ring that is connected to a computer via a cable. When the bottle and the ring were inverted, a switch closed, causing an electromagnetic driver coil in the ring to be energized, which opened the valve in the spout. The valve was held open for a defined period of time which dispensed a given volume of liquor because of a relatively constant flow rate through the spout. When that time period ends, the electromagnetic coil was deenergized by the computer, and the valve closed.

An improved and further developed version of the system of the noted '149 patent is shown in U.S. Pat. No. 5,603,430. The '430 patent provides a mechanism for automatically dispensing a predefined quantity of beverage from a container. The mechanism uniquely identifies the bottle from which the beverage is being poured, to account for the total quantity of beverage dispensed from that specific bottle. This also enables the inventory of the bar to be determined automatically at any instant in time. The mechanism calculates the total dollar value of beverage which has been dispensed from a bottle, and from all the bottles in a given bar during a specific period of time. A separate pourer spout is placed on each bottle, and each spout has a flow passage controlled by a magnetically operable valve and a transponder which transmits an identification code that is unique to that particular spout. The valve is operated by an actuator that is placed near to the spout in order to dispense the liquid. The actuator includes a valve operating driver coil that when energized produces a magnetic field which opens the valve. An interrogator is provided for activating the spout transducer and reading the identification code. A memory provides a group of storage locations associated with the identification code. Depending upon the sophistication desired for inventory and sales monitoring, the storage locations contain a variety of data related to the dispensing of liquid from the bottle to which the spout is attached. For example, such information can include the quantity of liquid dispensed from a bottle and a number of volume units of liquid present in that bottle when full, and/or the price of the liquid per volume unit. Other information can include the interval to hold the valve open to dispense a serving of liquid, a volume of a serving and the total sales of that kind of liquid. By storing the name of the liquid, the name can be displayed to the user while dispensing is occurring. A controller is connected to the interrogator to receive the identification code from the pourer spout and is connected to the actuator to control production of the magnetic field to open the stopper valve for a predetermined period of time, the controller being coupled to the memory and updating the data regarding a volume dispensed from the liquid container in response to the valve being opened, the controller including the mechanism for calculating a quantity of liquid remaining in the liquid container.

Another beverage dispenser coding device is shown in U.S. Pat. No. 5,295,611. The '611 patent shows a non-contact coding device working in a magnetic field, for use with a liquor bottle pourer spout and a electromagnetic valve. A primary coil on an actuator ring couples with a secondary coil in the pourer spout to read the identification code.

SUMMARY OF THE INVENTION

The present invention provides an improved identification system enabling easier detection, and greater strength and integrity of detected signal. A beverage dispenser transponder identification system is provided including a pourer spout for insertion into a bottle containing a beverage, the pourer spout having an electromagnetically actuator stopper valve for dispensing the beverage, the pourer spout having an rf receive/transmit antenna coupled to an identification transponder circuit. The system includes an actuator for activating the pourer spout, the actuator having a driver coil for actuating the stopper valve, an rf transmit antenna connected to an oscillator, and an rf receive antenna connected to a decoder. The rf transmit antenna broadcasts an rf signal to the rf receive/transmit antenna which is conducted to the identification transponder circuit which sends an identification signal to the rf receive/transmit antenna which is broadcast to the rf receive antenna and received by the decoder to identify the pourer spout. The oscillator and decoder are separately connected to separate different antennas, namely the rf transmit antenna and the rf receive antenna, respectively. The oscillator and the decoder are ohmically isolated from each other. The oscillator is connected to the rf transmit antenna by a first conductor, and the rf receive antenna is connected to the decoder by a second conductor. The second conductor carries only the signal from the rf receive antenna and not the signal on the first conductor from the oscillator. The second conductor carries only the signal from the rf receive antenna without interference from the signal from on the first conductor from the oscillator, to reduce degradation of and identifiability and integrity of desired detection otherwise due to presence of an additional signal from the oscillator, such that the signal on the second conductor from the rf receive antenna to the decoder is easier to detect and has greater strength and integrity.

BRIEF DESCRIPTION OF THE DRAWINGS

PRIOR ART

Figure 1:
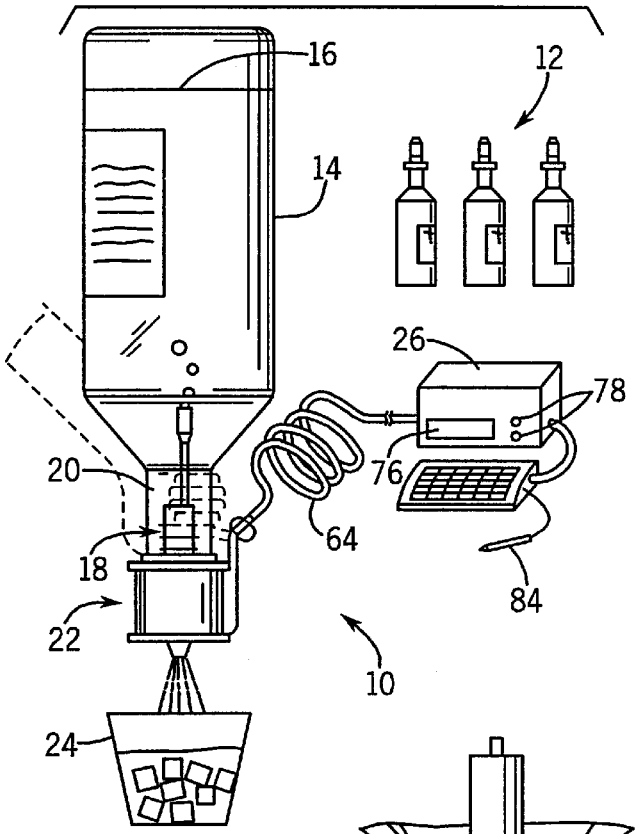
FIG. 1 PRIOR ART

FIG. 1 is a pictorial illustration of a beverage dispenser system and is taken from FIG. 1 of U.S. Pat. No. 5,603,430, incorporated herein by reference, and uses like reference numerals therefrom to facilitate understanding.

Figure 2:
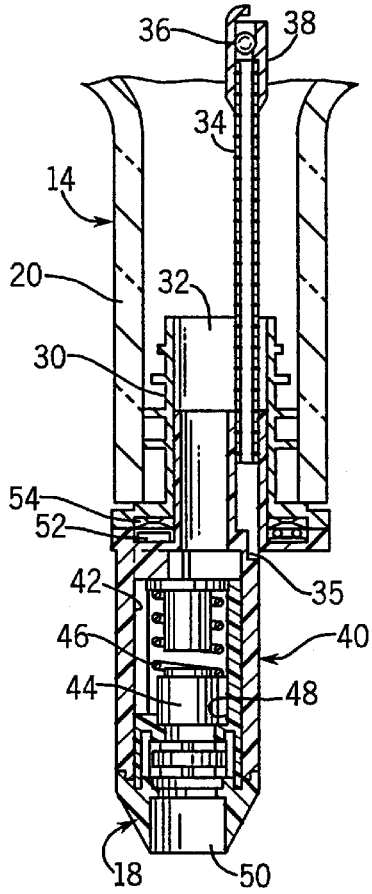
FIG. 2 PRIOR ART
Figure 3:
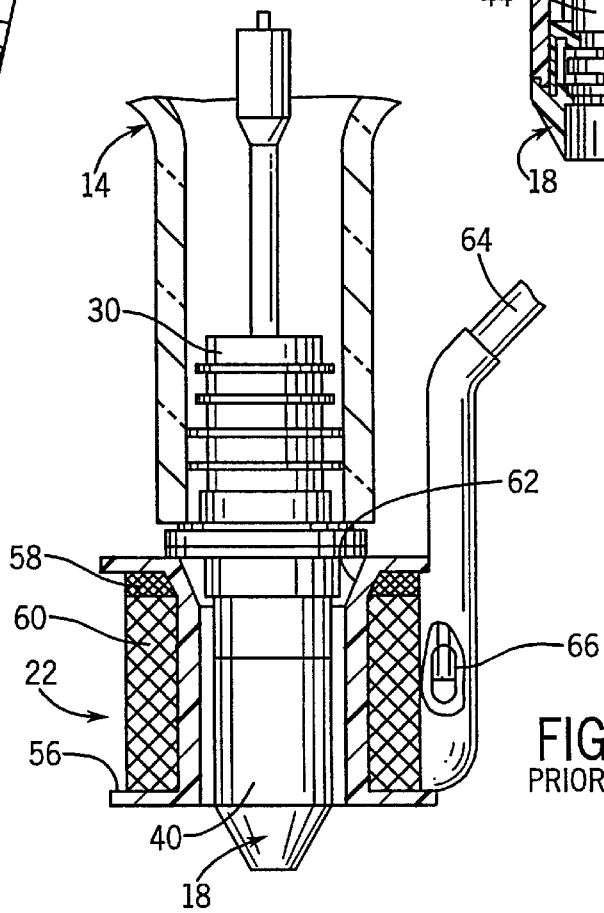
FIG. 3 PRIOR ART

FIG. 2 is an enlarged cross sectional view of a pourer spout used in the beverage dispensing system of FIG. 1, and is taken from FIG. 3 of the incorporated '430 patent.

Figure 4:
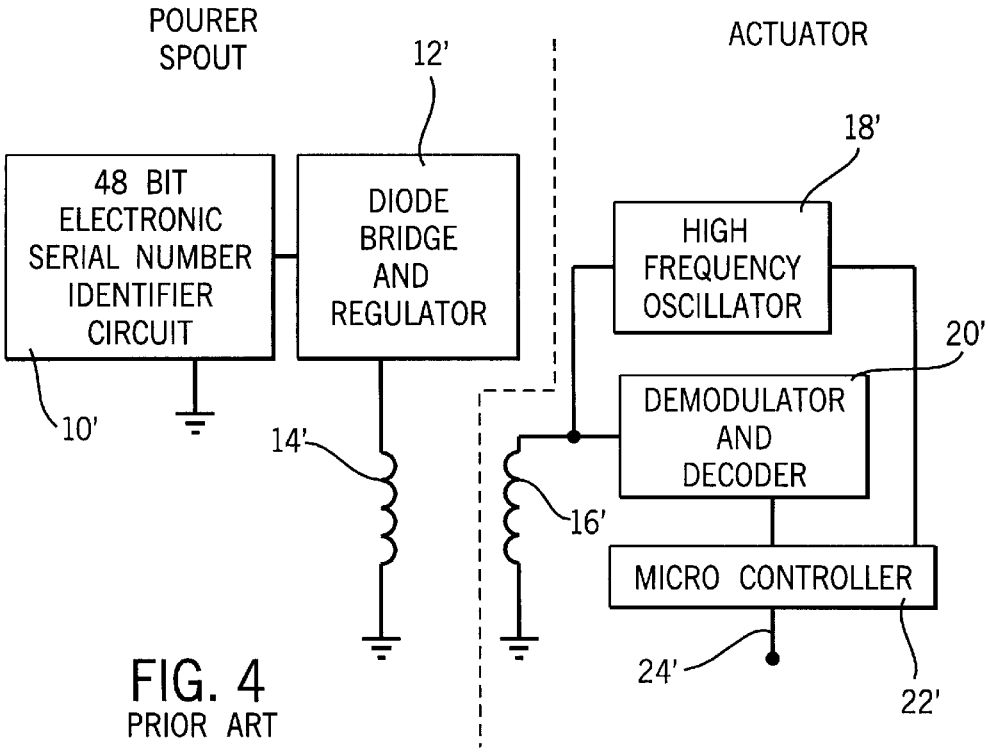
FIG. 4 PRIOR ART

FIG. 3 is a partial cross sectional view of a pourer spout and an actuator attached to a beverage bottle and is taken from FIG. 4 of the incorporated '430 patent.

FIG. 4 is block diagram of a beverage dispenser coding device, and is taken from FIG. 1 of U.S. Pat. No. 5,295,611, incorporated herein by reference, and uses like reference numerals with a prime to facilitate understanding.

Figure 5:
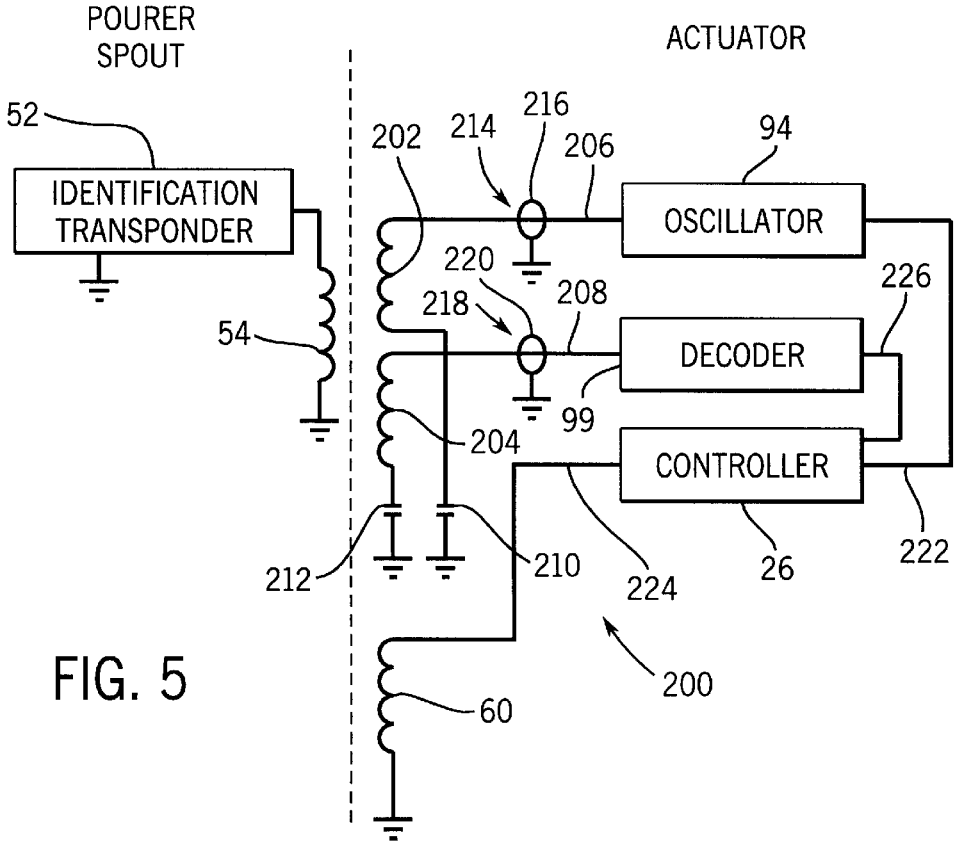

FIG. 5 is a block diagram of a beverage dispenser transponder identification system in accordance with the invention.

PRESENT INVENTION

DETAILED DESCRIPTION

PRIOR ART

As noted in the incorporated '430 patent, a facility such as a large tavern or hotel may have several bars at which alcoholic beverages are served. A beverage system monitors the serving of beverages to provide liquor inventory accounting and productivity reports for each bar and the entire facility. The system includes a separate beverage dispensing station 10 at each bar and a large bar may have several beverage dispensing stations, one for each bartender for example. The beverage dispensing stations are connected via a local area network which provides two-way communication typically with a computer located in the office of the beverage manager for the facility. Each beverage dispensing station tabulates the liquor sales at that bar location and periodically transmits the tabulated data to the manager's computer, which uses the transferred data to produce reports on liquor inventory and productivity of each dispensing station and the tavern or hotel as a whole. Although the beverage dispensing stations are specifically designed for a facility where several of them are networked together, a single beverage dispensing station can be used in a stand-alone manner in a small neighborhood bar to provide the same type of inventory monitoring.

In order to monitor beverage dispensing, each station 10 operates in connection with a number of different pourer spouts placed on liquid containers, such as liquor bottles 12 kept at a bar. Liquor 16 is shown being poured from a particular bottle 14 into a glass 24, such as the type for serving mixed alcoholic drinks in a tavern or the like. A pourer spout 18 is inserted into the open neck 20 of bottle 14 and projects outwardly therefrom.

The pourer spout 18 has an internal stopper valve that is operated by a spout actuator or activator ring 22 into which the spout is placed in order to dispense liquor from the bottle. When the spout is coupled to actuator 22 and inverted by the bartender, the station 10 senses the inversion and interrogates a transponder within the spout 18. In response, the transponder transmits a unique code identifying that particular spout 18 and thus the liquor bottle attached to the spout. Upon receiving the identification code, a controller 26 energizes the actuator 22 to open a stopper valve within the pourer spout 18 causing liquor to flow into glass 24 for a predetermined interval of time.

Dispensing station 10 finds special application as a means for serving liquor from a number of bottles 12 at a bar and for accounting not only for the volume of liquor dispensed from the bottles but also the total dollar volume of the liquor dispensed. Because the flow rate of liquor through the spout 18 is relatively constant, the controller 26 is able to calculate the volume of liquor that is dispensed while the stopper valve is open. This dispensed volume is used to update the stored records of the total amount of liquor dispensed from that particular bottle 14. In addition, the controller has been programmed with the cost of a volume unit of the liquor for that bottle and is able to determine the dollar volume of the beverage that has been dispensed therefrom. The controller 26 also can be programmed with the total volume of a full beverage bottle when a new pourer spout is attached. This enables the controller to derive how much liquor remains in the bottle by subtracting the dispensed volume from the full bottle volume. Records of these parameters can be kept on a work shift basis to determine the amount of liquor dispensed and the total dollar amount taken in during each work shift. The recorded sales information can be reconciled with the money that is present in the tavern cash registers at the end of the work shift.

The pourer spout 18 is shown in greater detail in FIG. 2 and includes a plastic liner 30 making a water tight seal between the spout 18 and the inner surface of the neck 20 of bottle 14. The liner 30 can have other constructions, if desired, such as a conventional cork. The spout 18 has a tamper-indicator, such as a stamp seal (not shown), to detect unauthorized attempts to remove the spout from the bottle. As a consequence, the only way to pour liquid from the bottle is to use the actuator 22. The liner 30 has a tubular configuration with an inner passage 32 through which the liquor in the bottle 14 enters the spout. The liner 30 also contains a breather tube 34 that allows air to pass into the bottle 14 to replace the liquor which flows outwardly through passage 32. A ball 36 held within a cage 38 at the inward end of the breather tube 34 prevents liquid from escaping through the breather tube. The air enters a breather hole 35 and flows through the breather tube 34 into the bottle.

The spout 18 has an external section 40 with an internal chamber 42 which is in fluid communication with passage 32. A movable valve member 44 is located within the chamber 32 and is biased by a spring 46 against a valve seat 48 in the normal position of the valve mechanism within the spout. Thus, the spout is normally closed preventing liquor 16 from flowing out of the bottle 14 through an outlet opening 50 in the end of the spout. Because the valve member 44 is made of ferromagnetic material, the application of an external magnetic field causes the valve member 44 to move against the force of spring 46 and away from seat 48 allowing beverage to flow from the bottle.

The external section 40 of spout 18 also contains a transponder circuit 52 coupled to an annular coil 54 in a cavity around inner passage 32. When coil 54 receives an rf (radio frequency) activation signal, the transponder circuit 52 applies a spout identification code signal to the coil. The device that sent the rf signal can detect the application of the identification code signal to transponder coil 54 and read the identification code from the transponder circuit. The identification code is unique to this particular spout 18, allowing the spout, and hence the particular bottle 14 to which it is attached, to be identified and to distinguished from the other bottles 12 at the bar. Each bottle at the bar has a spout with a different identification code.

Referring to FIG. 3, actuator 22 is placed around the section 40 of the pourer spout 18 that projects from the bottle 14. The actuator has an annular bobbin 56 of a type commonly used to support electromagnetic coils. The bobbin 56 has a tapered opening 62 at one end for receiving spout 18. An interrogator coil 58 is wound on the bobbin 56 near the one end and is adjacent to the transponder coil 54 when the actuator 22 is placed on the spout 18. A larger valve operating driver coil 60 also is wound around the bobbin 56 to provide an electromagnetic field which moves the spout stopper valve 44 away from seat 48 thereby allowing liquor to flow from the bottle 14, when the actuator activator ring 22 is inserted around pourer spout 18. A mercury tilt switch 66 is located within the actuator 22 so that the switch contacts open when the actuator is in the inverted position as illustrated in FIGS. 1 and 3. Wires from the interrogator coil 58, the valve operating driver coil 60 and tilt switch 66 form a cable 64 connected to controller 26 as shown in FIG. 1. Controller 26 and identification transponder circuit 52 are further shown in the incorporated '430 patent, FIGS. 5 and 6 respectively.

FIG. 4 shows the beverage dispenser coding device of the incorporated '611 patent. A printed circuit board on the magnetically activated bottle stopper valve includes a secondary coil 14' on its upper surface, and a microelectronic diode bridge and voltage regulator circuit 12' mounted on the underside of the board. Also mounted on the underside is an interrogated 48 bit serial number identifier circuit 10' which, when powered, will vary its impedance in a serial transmission fashion to give out its 48 bit serial number code. The printed circuit board can be mounted on a shoulder of the magnetically activated bottle stopper valve of the power spout, and thus can be ring shaped, with a conventional stopper valve being noted in U.S. Pat. No. 3,920,149, incorporated herein by reference. A primary coil 16' is provided on a base of an activator coil unit (not shown) of the actuator such that when the activator coil unit is placed on the stopper valve, the two coils 14' and 16' form a transformer unit. A microcontroller 22' gives a signal to a high frequency oscillator 18' to generate a high frequency signal driving coil 16'. As the power received by coil 14' is rectified and regulated by diode bridge and rectifier 12', the identifier circuit 10' begins changing the impedance serially and this time varying change in impedance affects the impedance of coil 14' which is detectable on coil 16'. The change of impedance of coil 14' is transmitted through coil 16' and then demodulated and decoded by circuit 20'. The resulting identification serial number is passed to microcontroller 22' which then outputs the identification number on output 24' which output can be used by a bar control system to know exactly which bottle is being used, which information is used for inventory purposes.

PRESENT INVENTION

FIG. 5 shows the present invention and uses like reference numerals from above and from the noted incorporated patents where appropriate to facilitate understanding. Beverage dispenser transponder identification system 200 includes the noted pourer spout 18 for insertion into a bottle 12 containing a beverage 16. The pourer spout has the noted electromagnetically actuated stopper valve 44 for dispensing the beverage. The pourer spout has an rf receive/transmit coil antenna 54 connected to identification transponder circuit 52. Actuator 22 is provided by the noted activator ring for insertion around pourer spout 18. The actuator has the noted driver coil 60 for actuating stopper valve 44. An rf transmit antenna 202, comparable to coil antenna 58, is connected to oscillator 94. An rf receive coil antenna 204 is connected to decoder 99. Rf transmit antenna 202 broadcasts an rf signal to rf receive/transmit antenna 54 which is conducted to identification transponder circuit 52 which sends an identification signal to rf receive/transmit 54 which is broadcast to rf receive antenna 204 and received by decoder 99 to identify the pourer spout 18.

Oscillator 94 and decoder 99 are separately connected to separate different antennas, namely rf transmit antenna 202 and rf receive antenna 204, respectively. Oscillator 94 and decoder 99 are ohmically isolated from each other. Oscillator 94 is connected to rf transmit antenna 202 by conductor 206. Rf receive antenna 204 is connected to decoder 99 by conductor 208. Conductor 208 carries only the signal from rf receive antenna 204, and not the signal on conductor 206 from oscillator 94. In this manner, conductor 208 carries only the signal from rf antenna 204 without interference from the signal on conductor 206 from oscillator 94, to reduce degradation of identifiability and integrity of desired detection otherwise due to presence of an additional signal from the oscillator from the conductor therefrom. In contrast, in the prior art, as noted above, the same coil 58, FIG. 3, or 16' FIG. 4, is used to both send the signal from the oscillator and receive the return signal to be transmitted to the decoder. In the later arrangement, as shown in FIG. 4, oscillator 18' and decoder 20' are not separately connected to separate different antennas and are not ohmically isolated, and hence decoder 20' sees not only the identification signal from coil 16' but also the signal from oscillator 18' ohmically connected to the conductor between coil 16' and decoder 20'. In FIG. 4, the conductor wire from coil 16' to decoder 20' carries both the signal from coil 14' and the hard wire connected signal from oscillator 18'. The presence of both such signals on the input conductor to decoder 20' degrades identifiability and integrity of the signal which is desired to be detected, namely the identification signal from the pourer spout. In contrast, in the system of FIG. 5, there is no signal from oscillator 94 ohmically on the input conductor 208 to decoder 99, and hence there is no dominant effect thereof detracting from the desired identification signal sensing and discrimination from identification transponder circuit 52.

Conductor 206 carries only the signal from oscillator 94, and conductor 208 carries only the signal from rf receive antenna 204, respectively, without ohmic interference from each other. Conductor 206 carries only the signal from oscillator 94 without ohmic interference from the signal on conductor 208 from rf receive antenna 204. Conductor 208 carries only the signal from rf receive antenna 204 without ohmic interference from the signal on conductor 208 from oscillator 94. Hence, conductor 208 carries only the signal from rf receive antenna 204 without degradation of identifiability and integrity of desired detention otherwise due to the noted additional presence in the prior art of the signal from the oscillator on its respective output conductor.

Rf transmit antenna 202 and rf receive antenna 204 are separate antennas ohmically isolated from each other. Oscillator 94 is ohmically connected only to rf transmit antenna 204, and not to rf receive antenna 204. Decoder 99 is ohmically connected only to rf receive antenna 204, and not to rf transmit antenna 202. Tuning capacitor 210 is connected to rf transmit antenna 202. Tuning capacitor 212 is connected to rf receive antenna 204. Capacitor 210 and rf transmit coil antenna 202 form a tank circuit tuned to a given frequency, 13.5 megahertz (MHz) being a typical frequency. Capacitor 212 and rf receive coil antenna 204 form a second tank circuit tuned to the same said given frequency. A first coaxial cable 214 has the noted central conductor 206 connecting oscillator 94 to rf transmit antenna 202 and has a grounded sheath 216. A second coaxial cable 218 has the noted central conductor 208 connecting decoder 99 to rf receive antenna 204, and has a grounded sheath 220.

Grounded sheathes 216 and 220 of coaxial cables 214 and 218 protect and isolate conductors 206 and 208 of coaxial cables 214 and 218 and oscillator 94 and decoder 99 from cross-talk and spurious interference, such that decoder 99 sees only the signal from rf receive antenna 204 without the signal from the oscillator 94 ohmically superimposed thereon or interfering with the signal that decoder 99 receives from rf receive antenna 204. The length of coaxial cable 218 is one-quarter wavelength of the noted given frequency, which is the operating frequency of the rf circuitry, to provide voltage step-up for improved signal strength and detection. To provide such voltage step-up, the output of conductor 208 is provided with a higher impedance at decoder 99 than that at coil antenna 204. Controller 26 is provided as above and has an output 222 to oscillator 94, an output 224 to driver coil 60, and an input 226 from decoder 99.

It is recognized that various equivalents, alternatives and modifications are possible within the scope of the appended claims.

What is claimed is:

1. A beverage dispenser transponder identification system comprising a pourer spout for insertion into a bottle containing a beverage, said pourer spout having an electromagnetically actuated stopper valve for dispensing said beverage, said pourer spout having an rf receive/transmit antenna connected to an identification transponder circuit, an actuator for activating said pourer spout, said actuator having a driver coil for actuating said stopper valve, an rf transmit antenna connected to an oscillator, and an rf receive antenna connected to a decoder, said rf transmit antenna broadcasting an rf signal to said rf receive/transmit antenna which is conducted to said identification transponder circuit which sends an identification signal to said rf receive/transmit antenna which is broadcast to said rf receive antenna and received by said decoder to identify said pourer spout.

2. The invention according to claim 1 wherein said oscillator and said decoder are separately connected to separate different antennas, namely said rf transmit antenna and said rf receive antenna, respectively.

3. The invention according to claim 2 wherein said oscillator and said decoder are ohmically isolated from each other.

4. The invention according to claim 3 wherein said oscillator is connected to said rf transmit antenna by a first conductor, said rf receive antenna is connected to said decoder by a second conductor, and said second conductor carries only the signal from said rf receive antenna and not the signal on said first conductor from said oscillator.

5. The invention according to claim 1 wherein said oscillator is connected to said rf transmit antenna by a first conductor, said rf receive antenna is connected to said decoder by a second conductor, and wherein said second conductor carries only the signal from said rf receive antenna without ohmic interference of the signal on said first conductor from said oscillator, to reduce degradation of identifiability and integrity of desired detection otherwise due to presence of an additional signal from said oscillator, such that the signal on said second conductor from said rf receive antenna to said decoder is easier to detect and has greater strength and integrity.

6. The invention according to claim 1 wherein said oscillator is connected to said rf transmit antenna by a first conductor, said rf receive antenna is connected to said decoder by a second conductor, and wherein said first and second conductors each carry only the respective signal from said oscillator and said rf receive antenna, respectively, without ohmic interference from each other, such that said second conductor carries only the signal from said rf receive antenna without degradation of identifiability and integrity of desired detection otherwise due to additional presence of the signal from said oscillator.

7. The invention according to claim 1 wherein said rf transmit antenna and said rf receive antenna are separate antennas ohmically isolated from each other.

8. The invention according to claim 7 wherein said oscillator is ohmically connected only to said rf transmit antenna and not to said rf receive antenna, and wherein said decoder is ohmically connected only to said rf receive antenna and not to said rf transmit antenna.

9. The invention according to claim 1 comprising a first tuning capacitor connected to said rf transmit antenna, and a second tuning capacitor connected to said rf receive antenna.

10. The invention according to claim 9 wherein said first capacitor and said rf transmit antenna comprise a first tank circuit tuned to a given frequency, and said second capacitor and said rf receive antenna comprise a second tank circuit tuned to the same said give frequency.

11. The invention according to claim 1 comprising a first coaxial cable having a conductor connecting said oscillator to said rf transmit antenna, said first coaxial cable having a grounded sheath, a second coaxial cable having a conductor connecting said decoder to said rf receive antenna, said second coaxial cable having a grounded sheath, said grounded sheathes of said first and second coaxial cables protecting and isolating said conductors of said first and second coaxial cables and said oscillator and said decoder from cross-talk and a spurious interference therebetween, such that said decoder sees only the signal from said rf receive antenna without the signal from said oscillator ohmically superimposed thereon or interfering with the signal that said decoder receives from said rf receive antenna.

12. The invention according to claim 1 comprising a tank circuit connected to said rf receive antenna and tuned to a given frequency, and a coaxial cable connecting said rf receive antenna to said decoder and having a length equal to onequarter wavelength of said given frequency.

13. The invention according to claim 1 comprising a controller having a first output to said oscillator, a second output to said driver coil, and an input from said decoder.

* * * * *